US006374632B1

(12) United States Patent
Nobuta et al.

(10) Patent No.: US 6,374,632 B1
(45) Date of Patent: Apr. 23, 2002

(54) RECEIVER AND REFRIGERANT CYCLE SYSTEM

(75) Inventors: Tetsuji Nobuta; Hiroki Matsuo; Kazuya Makizono, all of Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/671,842

(22) Filed: Sep. 27, 2000

Related U.S. Application Data

(63) Continuation-in-part of application No. 09/328,573, filed on Jun. 9, 1999, now abandoned.

(30) Foreign Application Priority Data

Jun. 16, 1998 (JP) ..... 10-168702
Sep. 28, 1999 (JP) ..... 11-274728

(51) Int. Cl.[7] ..... F25B 39/04; F28F 9/02
(52) U.S. Cl. ..... 62/509; 165/143; 165/173
(58) Field of Search ..... 62/509, 507, 503, 62/506, 512, 474; 165/132, 143, 173, 110, 175, 176

(56) References Cited

U.S. PATENT DOCUMENTS 5,228,315 A 7/1993 Nagasaka et al.
5,546,761 A 8/1996 Matsuo et al.
5,582,027 A 12/1996 Baba et al.
5,868,002 A 2/1999 Matsubayashi

FOREIGN PATENT DOCUMENTS

JP A-6-94329 4/1994
JP A-2000-74527 3/2000

*Primary Examiner*—Denise L Esquivel
*Assistant Examiner*—Chen-Wen Jiang
(74) *Attorney, Agent, or Firm*—Harness, Dickey & Pierce, PLC

(57) ABSTRACT

In a receiver for separating gas refrigerant and liquid refrigerant and for storing liquid refrigerant for a refrigerant cycle, refrigerant form a condensing portion of a condenser flows into an upper side of a tank member of the receiver from a first refrigerant inlet and flows into a lower side of the tank portion from a second refrigerant inlet. Further, liquid refrigerant stored in the tank member of the receiver is discharged to an outside through a refrigerant outlet. Accordingly, refrigerant from the condensing portion of the condenser flows into the tank portion of the receiver from both upper and lower sides of a gas-liquid boundary surface. As a result, it can prevent the gas-liquid boundary surface of the receiver from being disturbed during a refrigerant introduction of the receiver, while cooling effect of the upper side of the receiver is effectively improved.

32 Claims, 11 Drawing Sheets

RECEIVER AND REFRIGERANT CYCLE SYSTEM

CROSS-REFERENCE TO RELATED APPLICATION

This application is a CIP application of U.S. application Ser. No. 09/328,573, filed on Jun. 9, 1999, now abandoned. The present invention is related to Japanese Patent Applications No. Hei. 10-168702 filed on Jun. 16, 1998 and No. Hei. 11-274728 filed on Sep. 28, 1999, the contents of which are hereby incorporated by reference.

BACKGROUND OF THE INVENTION

1. Field of the Invention

The present invention generally relates to a refrigerant cycle system with an improved refrigerant-sealing performance. More particularly, the present invention relates to a receiver-integrated condenser of a refrigerant cycle, and also relates to a receiver separated from a condenser of a refrigerant cycle, which are suitably applied to an automotive air conditioner.

2. Description of Related Art

In a refrigerant cycle of a conventional air conditioner, a receiver and a condenser are integrally formed so that an installation space of the receiver and the condenser in a vehicle is reduced. For example, U.S. Pat. No. 5,546,761 discloses a receiver-integrated refrigerant condenser as shown in FIG. 13. The receiver-integrated refrigerant condenser includes a pair of first and second header tanks 121, 122, and a core portion 123 disposed between the first and second heater tanks 121, 122. Further, separators are disposed in the first and second header tank 121, 122 so that inner spaces of the first and second header tanks 121, 122 are separated into plural spaces, respectively. As shown in FIG. 13, a receiving unit 131 is formed integrally with the second header tank 122 in the receiver-integrated refrigerant condenser. An inner space of the receiving unit 131 communicates with the second header tank 122 through a first communication hole 132 provided at a lower side of the second header tank 122, so that liquid refrigerant condensed in a condensing portion 136 of the core portion 123 flows into the receiving unit 131 through the first communication hole 132. Refrigerant flowing into the receiving unit 131 is separated into gas refrigerant and liquid refrigerant, and the liquid refrigerant is stored in the receiving unit 131. Further, a second communication hole 135 is provided in the second header tank 122 at a lower side of the first communication hole 132. Thus, liquid refrigerant within the receiving unit 131 flows into the second header tank 122 from the second communication hole 135, and flows into a super-cooling portion 137 of the core portion 123.

However, in the conventional receiver-integrated refrigerant condenser, heat from the second header tank 122 is transmitted to refrigerant within the receiving unit 131, and is stored in the refrigerant of the receiving unit 131. That is, when refrigerant amount sealed in the refrigerant cycle is increased after bubbles disappear, liquid refrigerant surface within the receiving unit 131 is increased to become higher. Therefore, liquid refrigerant in the receiving unit 131 is boiled by the transmitted heat, and gas refrigerant is increased in the receiving unit 131. In this case, when a little amount of refrigerant is added in the refrigerant cycle after bubbles disappear, super-cooling degree of the liquid refrigerant is increased, and operation power for driving a compressor of the refrigerant cycle is increased. Further, in a case where the receiving unit 131 is not cooled by cool air, it is difficult to maintain the super-cooling degree in a predetermined range when refrigerant amount sealed in the refrigerant cycle is increased. As a result, refrigerant sealing performance of the refrigerant cycle is deteriorated.

On the other hand, in a conventional receiver separated from a condenser of a refrigerant cycle, all refrigerant from the condenser is introduced into the receiver from an upper side inlet or a lower side inlet of the receiver. When an entire amount of refrigerant flowing from the condenser is introduced from the upper side inlet of the receiver and flows downwardly in the receiver, a gas-liquid boundary surface is readily disturbed within the receiver by dynamical force of refrigerant flowing from the upper side inlet, and gas refrigerant may be mixed to refrigerant flowing into a super-cooling unit. Alternatively, when an entire amount of refrigerant flowing from the condenser is introduced from the lower side inlet of the receiver and flows upwardly in the receiver, because both refrigerant inlet and outlet are provided at the lower side of the receiver, refrigerant from the refrigerant inlet directly flows toward the refrigerant outlet, and it is difficult to cool an upper side of the receiver by refrigerant flowing from the condenser. As a result, when the receiver is used in a high-temperatures condition, liquid refrigerant at an upper side of the receiver may be boiled, and it is difficult to increase the liquid refrigerant surface within the receiver.

SUMMARY OF THE INVENTION

In view of the foregoing problems, it is an object of the present invention to provide a receiver with both refrigerant inlets, for a refrigerant cycle system, which improves refrigerant sealing performance.

It is an another object of the present invention to provide a refrigerant cycle system with a receiver, which prevents a disturbance of gas-liquid surface within the receiver, while improving cooling effect of refrigerant at an upper side of the receiver.

It is a further another object of the present invention to provide a receiver-integrated condenser for a refrigerant cycle system, which prevents heat from high-temperature refrigerant of a condensing portion from being directly transmitted to liquid refrigerant within a receiving unit.

According to the present invention, a receiver for a refrigerant cycle system includes a tank member for separating refrigerant from a condenser into gas refrigerant and liquid refrigerant and for storing liquid refrigerant therein, a first refrigerant inlet from which refrigerant from the condenser is directly introduced into an upper side within the tank member, a second refrigerant inlet from which refrigerant from the condenser is directly introduced into a lower side within the tank member, and a refrigerant outlet from which liquid refrigerant within the tank member is introduced to an outside of the tank member. Therefore, refrigerant from the condenser can be flow into both upper and lower sides of the tank member of the receiver from both the first and second refrigerant inlets. Thus, the upper side part of the receiver can be always cooled by refrigerant from the first refrigerant inlet, having passed through the condenser. Accordingly, even when the receiver is used around a vehicle engine or hot air having passed through a radiator flows around the receiver, it can effectively prevent liquid refrigerant at an upper side of the receiver from being boiled. As a result, a liquid refrigerant surface can move upwardly, and refrigerant sealing performance can be improved within the receiver. Further, because refrigerant from the condenser flows into both the upper and lower sides of the receiver from the first and second refrigerant inlets, a part of refrigerant can flow into liquid refrigerant within the receiver from the second refrigerant inlet, and a dynamical pressure of refrigerant from the first refrigerant inlet can be reduced. Accordingly, it can effectively prevent a gas-liquid boundary surface from being disturbed.

Preferably, the receiver further includes an inlet pipe, disposed in the tank member to extend in an up-down direction, through which refrigerant from the condenser flows. Further, the first refrigerant inlet is provided in the inlet pipe at an upper side of the inlet pipe, and the second refrigerant inlet is provided in the inlet pipe at a position lower than the first refrigerant inlet. Therefore, refrigerant from the condenser can readily flow upper and lower sides of the receiver with a simple structure.

More preferably, the inlet pipe is disposed in the tank member in such a manner that refrigerant from the first refrigerant inlet flows toward a top inner surface of the tank member. Therefore, upper side part of the receiver can be further effectively cooled by refrigerant from the first refrigerant inlet, and a disturbance of the gas-liquid boundary surface of the receiver can be effectively prevented.

According to the present invention, the tank member of the receiver can be integrally provided with the condenser, or can be coupled with the condenser through a pipe member. For example, a receiver-integrated condenser includes a core portion having a plurality of tubes through which refrigerant flows in a horizontal direction, a first header tank connected to each one side end of the tubes to extend in a vertical direction perpendicular to the vertical direction, a second header tank connected to each the other side end of the tubes to extend in the vertical direction, a receiving unit for separating gas refrigerant and liquid refrigerant and for receiving liquid refrigerant, and a separator disposed within the second header tank in such a manner that an inner space of the second header tank is partitioned into upper and lower spaces in the vertical direction. In the receiver-integrated condenser, the receiving unit is integrated with the second header tank in such a manner that a communication passage extending over both sides of the separator in the vertical direction is defined by the receiving unit and the second header tank, and the second header tank communicates with the communication passage in such a manner that refrigerant condensed in the core portion flows into the communication passage through the lower space of the second header tank. Thus, it can prevent heat from high-temperature refrigerant in the upper space of the second header tank from being directly transmitted to refrigerant within the receiving unit, and further prevent heat from being stored in the receiving unit. That is, because low-temperature refrigerant continually flows through the communication passage, heat is not stored in refrigerant flowing through the communication passage. As a result, even when cool air is not blown toward the receiving unit, it can restrict liquid refrigerant is evaporated in the receiving unit, and an inner space of the receiving unit can be effectively used for storing liquid refrigerant for the refrigerant cycle.

Preferably, the communication passage communicates with the receiving unit in such a manner that refrigerant in the communication passage flows into the receiving unit from upper and lower sides. Therefore, refrigerant condensed in the core portion flows into the receiving unit from upper and lower sides of the communication passage. Thus, low-temperature refrigerant flowing through the communication passage is inserted between high-temperature refrigerant in the upper space of the second header tank and refrigerant in the receiving unit. As a result, refrigerant sealing performance, for approximately maintaining refrigerant super-cooling degree at a predetermined degree relative to an increased refrigerant amount in the refrigerant cycle, can be improved. Accordingly, it can prevent operation power for operating the compressor from being increased due to super-sealing refrigerant amount in the refrigerant cycle.

More preferably, refrigerant in the communication passage flows into the receiving unit through a first communication hole at a lower side and a second hole at an upper side of the first communication hole. Further, a ratio of a second opening area of the second communication hole to a first opening area of the first communication hole is in a range of 2–4. Thus, refrigerant sealing performance of the refrigerant cycle can be further improved.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

Figure 1:
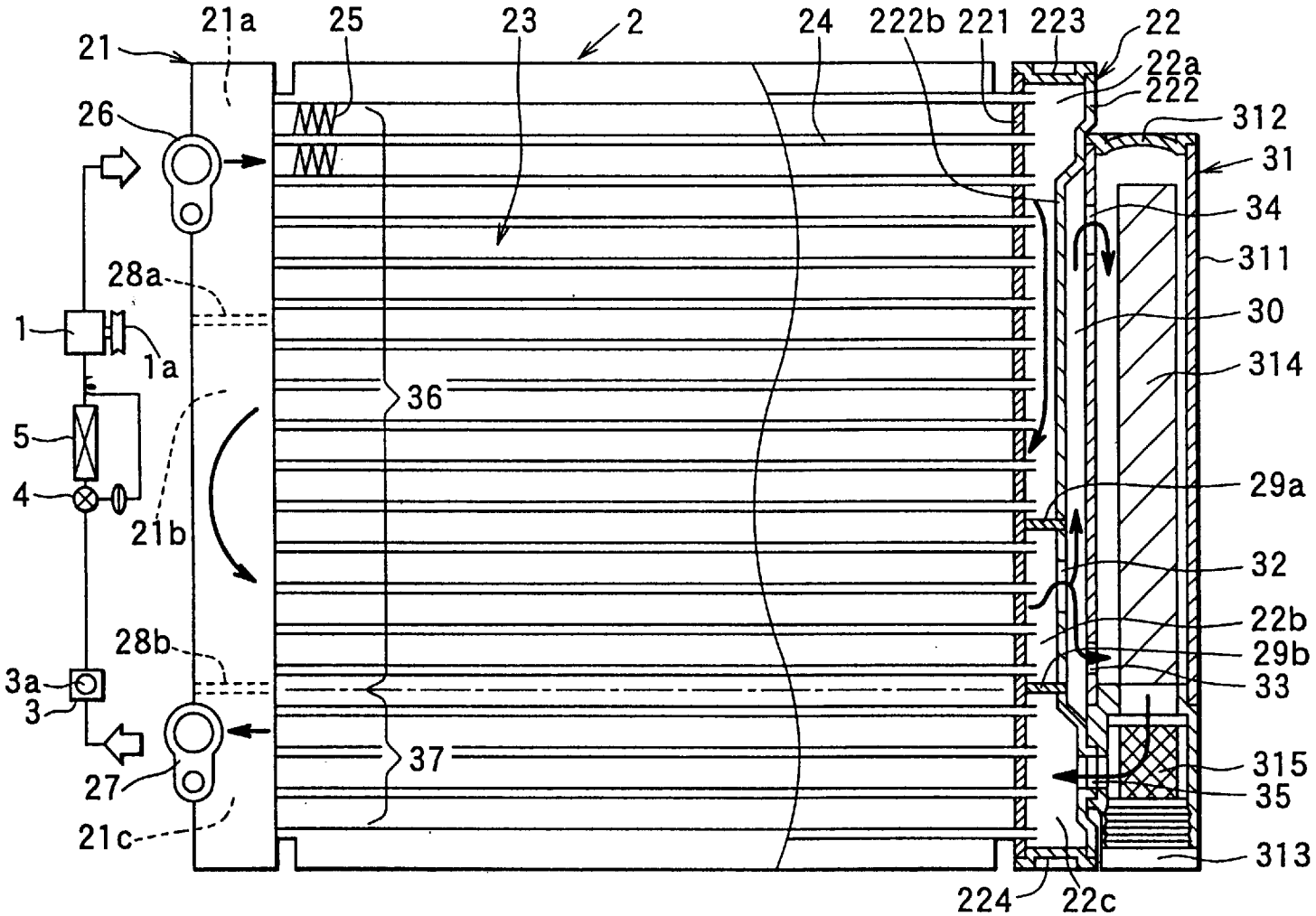
FIG. 1 is a partially-sectional view showing a refrigerant cycle according to a first preferred embodiment of the present invention.

A first preferred embodiment of the present invention will be now described with reference to FIGS. 1–4. In the first embodiment, the present invention is typically applied to a refrigerant cycle of an automotive air conditioner. As shown in FIG. 1, The refrigerant cycle of the automotive air conditioner includes a refrigerant compressor 1, a receiver-integrated refrigerant condenser 2, a sight glass 3, an expansion valve 4, and a refrigerant evaporator 5. All of components of the refrigerant cycle are serially connected by a metal pipe or a rubber pipe to form a closed circuit.

The compressor 1 is connected to an engine disposed within an engine compartment through a belt and an electromagnetic clutch 1*a*. When the rotation power of the engine is transmitted to the compressor 1 through the electromagnetic clutch 1*a*, the compressor 1 compresses gas refrigerant sucked therein from the evaporator 5 and then discharges high-pressure high-temperature gas refrigerant to the receiver-integrated refrigerant condenser 2.

The receiver-integrated refrigerant condenser 2 includes a pair of first and second header tanks 21, 22 each of which extends in an up-down direction (i.e., vertical direction) and is formed into approximately cylindrically. A core portion 23 is disposed between the first and second header tanks 21, 22.

The core portion 23 includes plural flat tubes 24 through which refrigerant flows horizontally between the first and second header tanks 21, 22, and plural corrugated fins 25 each of which is disposed between adjacent flat tubes 24. Each one side end of the flat tubes 24 communicates with the first header tank 21, and each the other side end of the flat tubes 24 communicates with the second header tank 22.

An inlet pipe 26 is connected to the first header tank 21 at an upper side, and an outlet pipe 27 is connected to the first header tank 21 at a lower side. In the first embodiment, first and second separators 28*a*, 28*b* are disposed within the first header tank 21, and third and fourth separator 29*a*, 29*b* are disposed within the second header tank 22. Thus, an inner space of the first header tank 21 is partitioned into upper, intermediate and lower spaces 21*a*, 21*b*, 21*c* in the up-down direction by the first and second separators 28*a*, 28*b*, and an inner space of the second header tank 22 is partitioned into upper, intermediate and lower spaces 22*a*, 22*b*, 22*c* in the up-down direction by the third and fourth separators 29*a*, 29*b*. Thus, refrigerant introduced from the inlet pipe 26 flows meanderingly between the first and second header tanks 21, 22 and the core portion 23.

In the first embodiment of the present invention, the first separator 28*a* is disposed in the first header tank 21 at an upper position relative to the third separator 29*a* disposed in the second header tank 22. On the other hand, the second separator 28*b* is disposed in the first header tank 21 at the same height position as the fourth separator 29*b* disposed in the second header tank 22.

A receiving unit 31 is formed integrally with the second header tank 22 in the receiver-integrated condenser. Gas refrigerant and liquid refrigerant are separated in the receiving unit 31, and liquid refrigerant is stored in the receiving unit 31. The receiving unit 31 is formed into an approximate cylindrical shape, and is connected to an outer surface of the second header tank 22 at a side opposite to the core portion 23. The receiving unit 31 has a height slightly lower than that of the second header tank 22, and an upper end of the receiving unit 31 extends to a position proximate to an upper end of the upper space 22*a* of the second header tank 22. Components of the receiver-integrated refrigerant condenser 2 including the receiving unit 31 are formed from aluminum material, and are assembled integrally by brazing.

Figure 2:
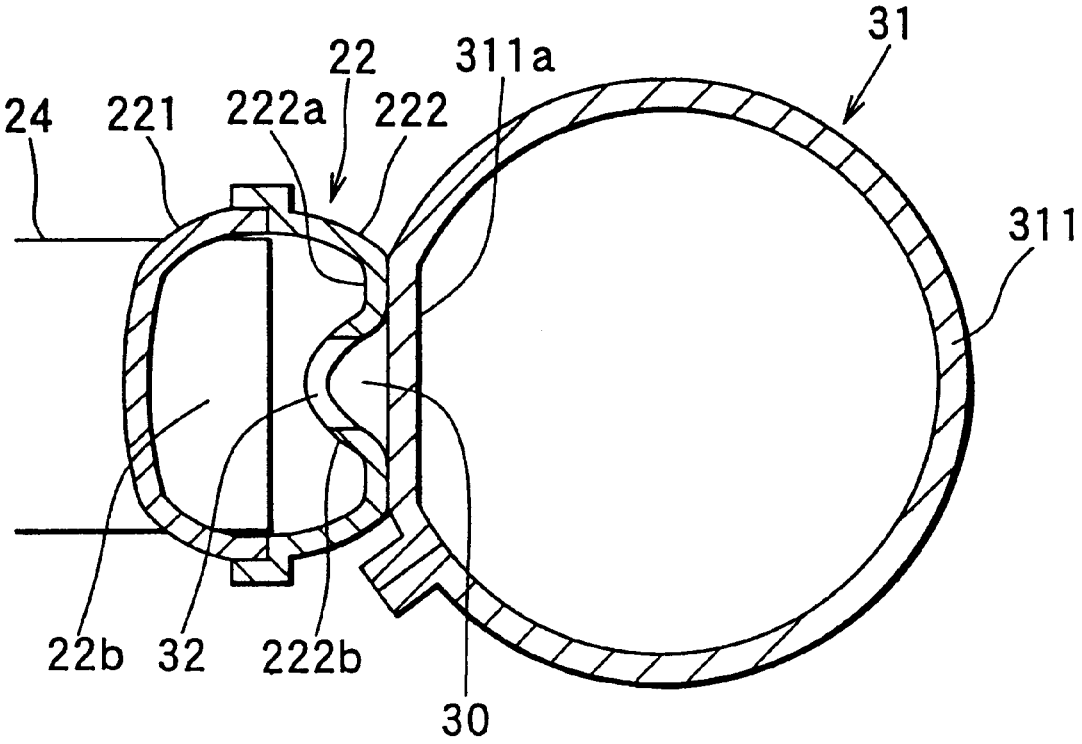
FIG. 2 is a transverse sectional view showing a main portion of a receiver-integrated refrigerant condenser of the refrigerant cycle according to the first embodiment.

Here, a communication structure communicating between an inner space of the receiving unit 31 and an inner space of the second header tank 22 will be now described. As shown in FIG. 2, the second header tank 22 includes a first plate 221 having a semicircular cross-section, and a second plate 222 having approximately a W-shaped cross-section. Each one side end of the flat tubes 24 is connected to the first plate 221, and the second plate 222 is connected to the first plate 221 to form the second header tank 22 having an approximate cylindrical shape. Upper and lower ends of the second header tank 22 are closed by cap members 223, 224.

On the other hand, as shown in FIG. 2, a cylindrical body portion 311 (tank member) of the receiving unit 31 is formed approximately cylindrically by bending and connecting a single plate. An upper end of the receiving unit 31 is closed by a cap member 312, and a lower end thereof is closed by an installation pedestal 313. The installation pedestal 313 is air-tightly detachably fixed to the body portion 311 through a seal member by using screwing means. A desiccant 314 for absorbing water contained in refrigerant and a filter 315 for removing dust contained in refrigerant are integrally formed on an upper side of the installation pedestal 313. The filter 315 is formed by a network structure having a cylindrical shape.

A flat portion 222*a* is formed in the second plate 222 of the second header tank 22, and a flat portion 311*a* is formed in the body portion 311 of the receiving unit 31, as shown in FIG. 2. In the first embodiment of the present invention, both of the flat portions 222*a*, 311*a* contact so that the receiving unit 31 is integrated with the second header tank 22. A recess portion 222*b* recessed from the flat portion 222*a* toward an inner side of the second heater tank 22 is formed at a center of the flat portion 222*a* of the second plate 222 of the second header tank 22.

The recess portion 222*b* is formed in the second plate 222 to extend in a longitudinal direction (i.e., vertical direction) of the second header tank 22 over both of the upper space 22*a* and the intermediate space 22*b*, so that a communication passage 30 extending in the vertical direction is defined by an outer side surface of the second plate 222 and an outer side surface of the cylindrical body portion 311 of the receiving unit 31. An upper end of the communication passage 30 is positioned adjacent to the upper end of the receiving unit 31.

As shown in FIG. 1, a first communication hole 32 is provided in the recess portion 222*b* at a center position between the third separator 29*a* and the fourth separator 29*b*, so that the intermediate space 22*b* of the second header tank 22 communicates with the communication passage 30 through the first communication hole 32. A second communication hole 33 is provided in the flat portion 311*a* of the body portion 311 of the receiving unit 31, so that an inner space of the receiving unit 31 communicates with a lower side of the communication passage 30. A third communication hole 34 is provided in the flat portion 311*a* of the body portion 311 of the receiving unit 31 at an upper side of the second communication hole 33, so that the inner space of the receiving unit 31 communicates with an upper side of the communication passage 30.

Because an amount of refrigerant flowing into the receiving unit 31 through the third communication hole 34 is made larger than that of refrigerant flowing into the receiving unit 31 through the second communication hole 33, an opening area $A_2$ of the third communication hole 34 is set to be larger enough as compared with an opening area $A_1$ of the second communication hole 33. In the first embodiment, each of the first, second and third communication holes 32–34 approximately has a vertical-longer rectangular shape.

Further, a fourth communication hole 35 is provided in the flat portion 311*a* of the cylindrical body portion 311 of the receiving unit 31 and the flat portion 222*a* of the second plate 222 of the second header tank 22 at a position lower than the fourth separator 29*b,* so that an inner space of the receiving unit 31 proximate to the bottom communicates with the lower space 22*c* of the second header tank 22. Therefore, liquid refrigerant stored in the receiving unit 31 passes through around the desiccant 314, certainly passes through the filter 315, and thereafter flows into the fourth communication hole 35.

An upper side portion in the core portion 23, on an upper side of the second and fourth separator 28*b,* 29*b,* forms a condensing portion 36 in which refringent is cooled and condensed by performing heat-exchange between refrigerant discharged from the compressor 1 and outside air blown by a cooling fan (not shown). Further, a lower side portion in the core portion 23, on a lower side of the second and fourth separators 28*b,* 29*b,* forms a super-cooling portion 37 in which liquid refrigerant separated in the receiving unit 31 is heat-exchanged with outside air to be super-cooled. Thus, in the first embodiment, the receiver-integrated refrigerant condenser 2 includes the condensing portion 36, the receiving unit 31 and the super-cooling portion 37 which are integrally assembled. When a refrigerant receiving amount is normal in the receiving unit 31, the gas-liquid interface surface within the receiving unit 31 is placed at an intermediate height position between the third separator 29*a* and an upper end surface of the receiving unit 31.

The receiver-integrated refrigerant condenser 2 is disposed at a most front portion within the engine compartment on a front side of a radiator, and both of the refrigerant condenser 2 and the radiator are cooled by a common cooling fan.

Next, the other components of the refrigerant cycle will be now simply described. The sight glass 3 is connected to a downstream refrigerant side of the super-cooling portion 37 of the receiver-integrated refrigerant condenser 2. The sight glass 3 is used as a refrigerant amount monitoring unit for monitoring the amount of refrigerant sealed in the refrigerant cycle to check for the over or short supply by observing gas-liquid state. The sight glass 3 has a peephole 3*a* airtightly sealed by a melted glass. When bubbles are found from the peephole 3*a,* it is determined that the amount of refrigerant is short-supplied. On the other hand, when bubbles are not founded, it is determined that refrigerant is properly supplied.

The expansion valve 4 is connected to a refrigerant inlet side of the evaporator 5. The expansion valve 4 is used as a decompressing unit in which high-temperature high-pressure liquid refrigerant is expanded to become in gas-liquid two phase refrigerant, so that a super-heating degree of refrigerant at a refrigerant outlet of the evaporator 5 is set at a predetermined value.

The refrigerant evaporator 5 is connected between a downstream refrigerant side of the expansion valve 4 and a suction side of the compressor 1. Inside air (i.e., air inside the passenger compartment) or outside air (i.e., air outside the passenger compartment) blown by a blower is heat-exchanged with refrigerant flowing through the evaporator 5, and is cooled by evaporating refrigerant in the evaporator 5. The evaporator 5 is disposed within a case of an air conditioner provided in a passenger compartment of a vehicle.

Next, operation of the refrigerant cycle will be described. When operation of the air conditioner starts and the electromagnetic clutch 1*a* is turned on, rotation power of the engine is transmitted to the compressor 1 so that refrigerant is pressed and discharged by the compressor 1. Thus, super-heating gas refrigerant discharged from the compressor 1 flows into the upper space 21*a* of the first header tank 21 of the condenser 2 through the inlet pipe 26. Refrigerant in the upper space 21*a* of the first header tank 21 flows into the upper space of the second header tank 22 after passing through the upper side tubes 24. Refrigerant is u-turned in the upper space 22*a* of the second header tank 22, flows through center tubes 24 in the condensing portion 36, and thereafter flows into the intermediate space 21*b* of the first header tank 21. Next, refrigerant is U-turned in the intermediate space 21*b* of the first header tank 21, flows through the lower side tubes 24 of the condensing portion 36, and flows into the intermediate space 22*b* of the second header tank 22. While refrigerant flows through the tubes 24 of the condensing portion 36 of the core portion 23, refrigerant is heat-exchanged with air to become in a saturation liquid refrigerant containing a part of gas refrigerant. The saturation liquid refrigerant flows into the communication passage 30 from the intermediate space 22*b* of the second header tank 22 through the first communication hole 32. Refrigerant within the communication passage 30 flows into the receiving unit 31 through the second communication hole 33 and the third communication hole 34.

Gas refrigerant and liquid refrigerant are separated in the receiving unit 31, and liquid refrigerant is stored in the receiving unit 31. Liquid refrigerant separated in the receiving unit 31 flows into the super-cooling portion 37 after passing through the fourth communication hole 35 and the lower space 22*c* of the second header tank 22. Liquid refrigerant is cooled again in the super-cooling portion 37, and super-cooled liquid refrigerant flows into the lower space 21*c* of the first header tank 21, and flows to the outside of the receiver-integrated refrigerant condenser 2 from the outlet pipe 27.

The super-cooled liquid refrigerant passes through the sight glass 3, and flows into the expansion valve 4. The super-cooled refrigerant is decompressed in the expansion valve 4 to becomes in low-temperature low pressure gas-liquid refrigerant. Gas-liquid refrigerant is heat-exchanged with air in the evaporator 5, so that air passing through the evaporator 5 is cooled by absorbing evaporation latent heat of refrigerant. Super-heating gas refrigerant evaporated in the evaporator 5 is sucked into the compressor 1 to be compressed again.

Next, refrigerant sealing performance (refrigerant receiving performance) of the refrigerant cycle due to the communication passage 30 and the second and third communication holes 33, 34 will be now described. According to the first embodiment of the present invention, refrigerant condensed in the condensing portion 36 of the core portion 23 flows into the receiving unit 31 from the second and third communication holes 33, 34 provided at lower and upper sides of the communication passage 30 after passing through the communication passage 30. That is, the communication passage 30 through which condensed refrigerant having a low temperature flows is sandwiched between the receiving unit 31 and the upper space 22*a* in which refrigerant having a high temperature flows. Therefore, heat of high-temperature refrigerant within the upper space 22*a* of the second header tank 22 is hardly directly transmitted to refrigerant within the receiving unit 31. Thus, even when the receiving unit 31 is placed at a position outside a lateral dimension of a cool air inlet of a front grille of the engine compartment and air is not blown toward the receiving unit 31, it can effectively prevent liquid refrigerant is evaporated in the receiving unit 31 by heat transmitted from high-temperature refrigerant in the upper space 22*a* of the second header tank 22. That is, heat is not stored in the liquid refrigerant in the receiving unit 31. As a result, all of the receiving unit 31 can be effectively used for storing liquid refrigerant.

Figure 3A:
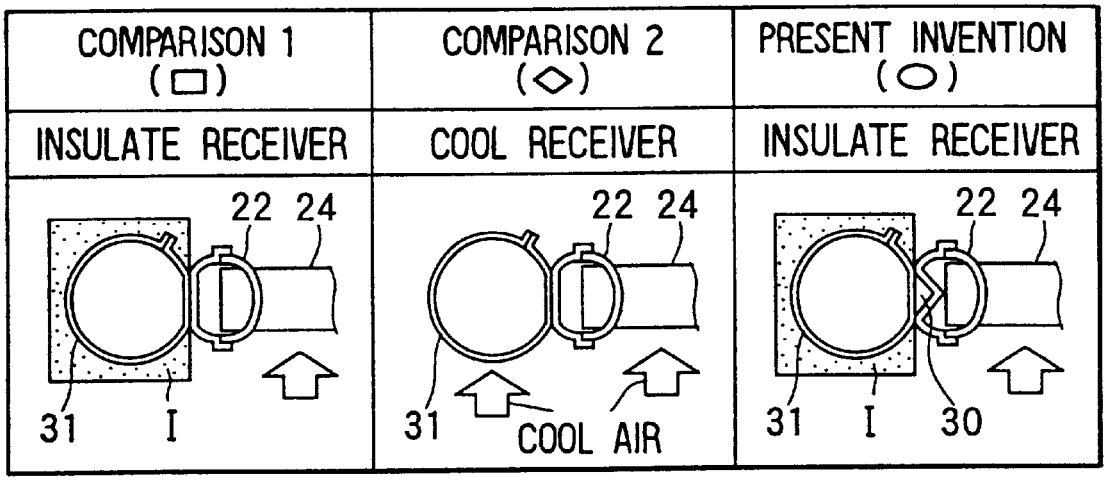
FIG. 3A is a view for comparing the receiver-integrated refrigerant condenser of the first embodiment with comparison 1 and comparison 2.
Figure 3B:
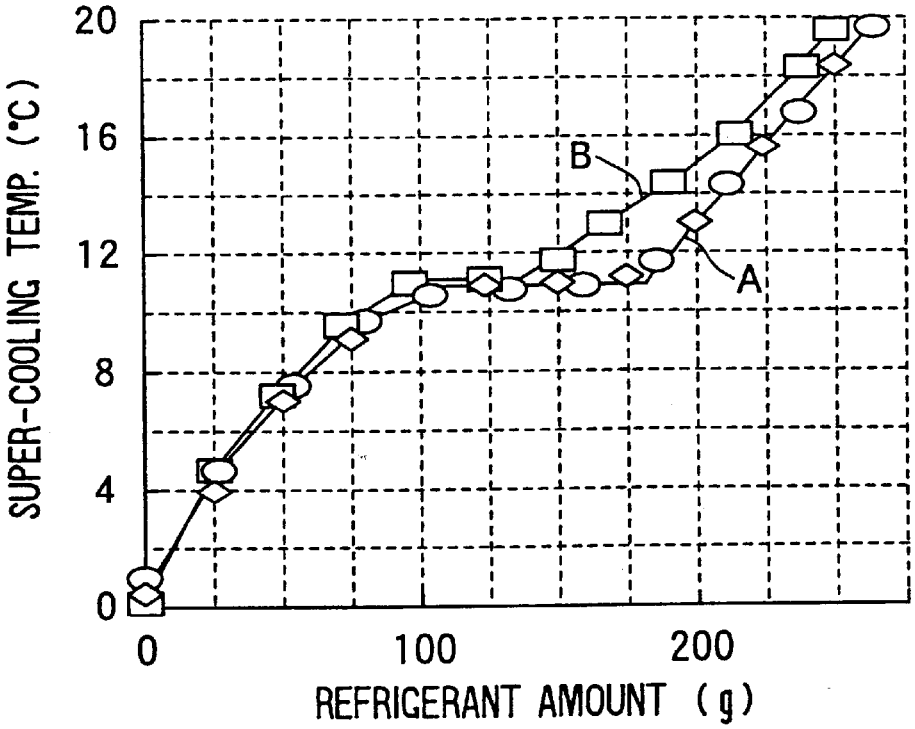
FIG. 3B is graphs showing the relationship between a super-cooling temperature (degree) of refrigerant and a refrigerant amount in the refrigerant cycle.

The inventors of the present invention experimentally produce present invention and comparisons 1 and 2 as shown in FIG. 3A, and compare the refrigerant sealing performance as shown in FIG. 3B. In the comparison 1 of FIG. 3A, the receiving unit 31 directly contacts the second header tank 22 while an insulation member I is disposed around the receiving unit 31. In the comparison 2 of FIG. 3A, the receiving unit 31 directly contacts the second header tank 22 while cool air is blown toward the receiving unit 31. In the present invention of FIG. 3A, the communication passage 30 is provided between the receiving unit 31 and the second header tank 22, while heat is insulated by the insulation member I. In FIG. 3B, the vertical axis indicates super-cooling temperature (i.e., super-cooling degree) of refrigerant flowing out from the outlet pipe 27 of the condenser 2, and the horizontal axis indicates refrigerant amount circulating in the refrigerant cycle after bubbles (gas refrigerant) disappear from refrigerant in the sight glass 3 at a downstream refrigerant side of the outlet pipe 27. In this experiment of FIG. 3B, the rotation speed of the engine is 1500 rpm, the outside air temperature is 30° C., and a maximum rotation speed of an inner fan is 450 $m^3/h$. To sufficiently maintain cooling performance, the super-cooling degree of refrigerant is set approximately at a predetermined degree when refrigerant amount circulating in the refrigerant cycle is in a range of 80–180 g after bubbles disappear. As shown by the comparison 2 in FIG. 3B, when cool air is sufficiently blown toward the receiving unit 31, a preferable refrigerant sealing performance can be obtained as shown by graph A in FIG. 3B. However, when the insulation member I is used as shown by the comparison 1, the super-cooling degree of liquid refrigerant is continually increased as the refrigerant amount sealed in the refrigerant cycle increases as shown by graph B. Thus, operation power of the compressor 1 is increased when the refrigerant amount is slightly increased in the refrigerant cycle after bubbles disappear.

According to the first embodiment of the present invention, even when cool air is not blown toward the receiving unit 31 and heat is insulated by the insulation member I, a suitable refrigerant sealing performance can be obtained as shown by graph A in FIG. 3B. That is, in the first embodiment, the communication passage 30 is provided between the second header tank 22 and the receiving unit 31 thereby preventing heat of high-temperature refrigerant in the upper space 22*a* of the second header tank 22 from being directly transmitted to refrigerant in the receiving unit 31. As a result, the refrigerant sealing performance of the refrigerant cycle can be improved in the present invention.

Figure 4A:
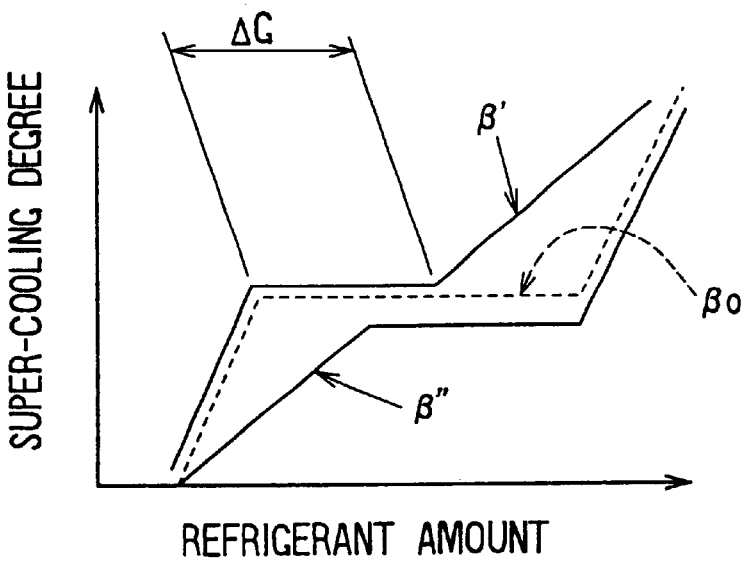
FIG. 4A is a graph for explaining refrigerant sealing performance due to a ratio $\beta$.
Figure 4B:
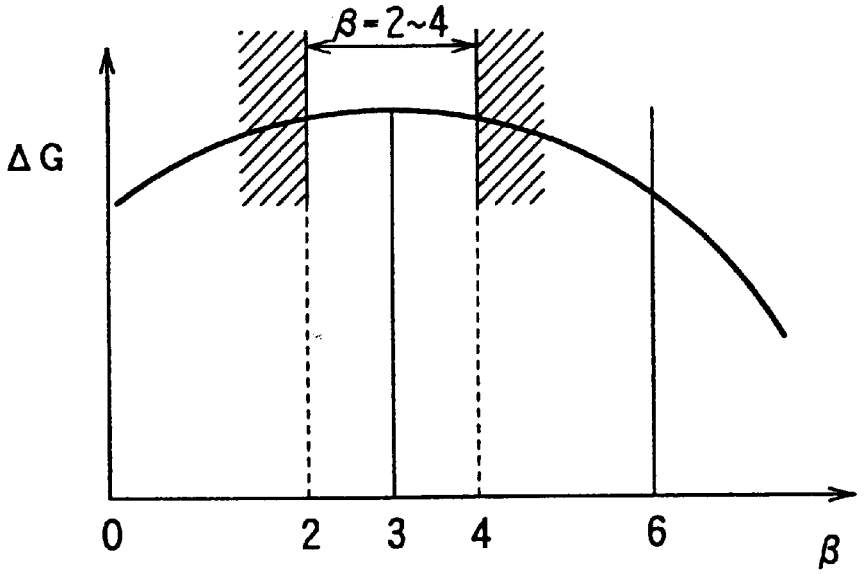
FIG. 4B is a graph showing the relationship between the ratio $\beta$ and a flat length $\Delta G$ indicated in FIG. 4A.

Further, a ratio β (i.e., $\beta=A_2/A_1$) of the opening area $A_2$ of the third communication hole 34 to an opening area $A_1$ of the second communication hole 33 is suitably set so that the refrigerant sealing performance can be further improved. That is, as shown in FIG. 4A, during a flat length ΔG, the super-cooling degree is maintained at an approximate certain degree even when the refrigerant amount in the refrigerant cycle is increases. Therefore, as the flat length ΔG is made longer, the refrigerant sealing performance is improved. In FIG. 4A, when the ratio β is set in a suitable range βo, the flat length ΔG becomes longer. When the ratio β is set to β' smaller than the suitable range βo, the flat length ΔG becomes shorter. When the ratio β is set to β" larger than the suitable range βo, the flat length ΔG also becomes shorter. As shown in FIG. 4B, when the ratio β is set in a range of 2–4, the flat length ΔG becomes maximum.

When the ratio β (i.e., $\beta=A_2/A_1$) is larger than 4, refrigerant mainly flows into the receiving unit 31 from the third communication hole 34, the interface surface between gas refrigerant and liquid refrigerant is not readily formed by dynamical pressure of refrigerant flowing into the receiving unit 31 from the third communication hole 34 at an upper side. As a result, until liquid refrigerant within the receiving unit 31 is increased to a predetermined degree, gas refrigerant flows from the receiving unit 31 to the super-cooling portion 37, thereby decreasing the refrigerant sealing performance. On the other hand, when the ratio β (i.e., $\beta=A_2/A_1$) is smaller that 2, heat-insulation effect due to the communication passage 30 is decreased, thereby decreasing the refrigerant sealing performance.

In the above-described first embodiment of the present invention, the recess portion 222*b* is formed in the flat portion 222*a* of the second plate 222 of the second header tank 22. However, a recess portion corresponding to the recess portion 222*b* may be formed in the flat portion 311*a* of the cylindrical body portion 311 of the receiving unit 31 to form the communication passage 30.

In the above-described first embodiment of the present invention, the receiving unit 31 is integrated with the second header tank 22 where both of the inlet and outlet pipes 26, 27 are not provided. However, the receiving unit 31 may be integrated with the first header tank 21 where the inlet and outlet pipes 26, 27 are provided.

Further, in the above-described first embodiment of the present invention, the second and third communication holes 33, 34 are provided so that refrigerant is introduced from the communication passage 30 to the receiving unit 31 through the second and third communication holes 33, 34. However, a single communication hole for introducing refrigerant in the communication passage 30 to the receiving unit 31 may be arbitrarily provided.

Figure 5:
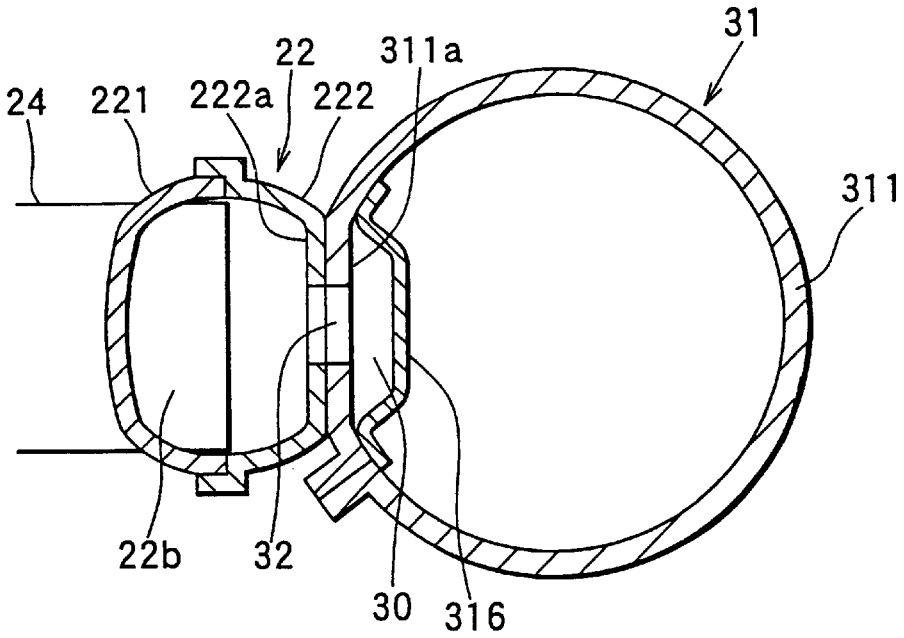
FIG. 5 is a transverse sectional view showing a main portion of a receiver-integrated refrigerant condenser of a refrigerant cycle according to a second preferred embodiment of the present invention.

A second preferred embodiment of the present invention will be now described with reference to FIG. 5. In the second embodiment of the present invention, the components similar to those in the first embodiment are indicated with the same reference numbers, and explanation thereof is omitted. As shown in FIG. 5, in the second embodiment, the communication passage 30 is provided in the cylindrical body portion 311 of the receiving unit 31. That is, a partition plate 316 extending in a longitudinal direction of the receiving unit 31 is bonded to an inner peripheral surface of the cylindrical body portion 311, and the communication hole 32 through which the communication passage 30 communicates with the inner space of the second header tank 22 is provided in the flat portion 222*a* of the second plate 222 and the flat portion 311*a* of the cylindrical body portion 311 of the receiving unit 31.

In the second embodiment, the second communication hole 33 is provided at a position adjacent to a lower end of the partition plate 316, and the third communication hole 34 is provided at a position adjacent to an upper end of the partition plate 316. Thus, the second embodiment of the present invention has the same effect as the first embodiment.

Figure 6:
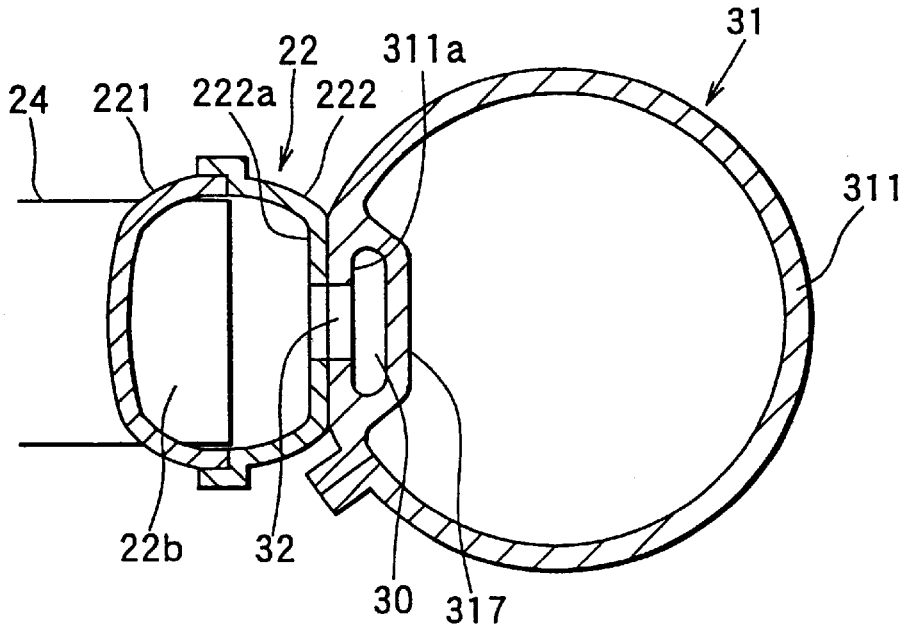
FIG. 6 is a transverse sectional view showing a main portion of a receiver-integrated refrigerant condenser of a refrigerant cycle according to a third preferred embodiment of the present invention.

A third preferred embodiment of the present invention will be now described with reference to FIG. 6. In the third embodiment of the present invention, the components similar to those in the first embodiment are indicated with the same reference numbers, and explanation thereof is omitted. As shown in FIG. 6, in the third embodiment, the cylindrical body portion 311 of the receiving unit 31 is formed by extruding an aluminum material. That is, during extruding, a hollow portion 317 extending in the up-down direction is formed in a part of the cylindrical body portion 311 in a circumferential direction. The hollow portion 317 has therein the communication passage 30. That is, in the third embodiment, the cylindrical body portion 311 including the hollow portion 317 corresponding the partition plate 316 of the second embodiment is formed integrally by protruding, so that the communication passage 30 is formed. Thus, the communication passage 30 can be defined in the cylindrical body portion 311 forming the receiving unit 31. Thus, in the third embodiment, an effect similar to that in the first embodiment can be obtained.

Figure 7:
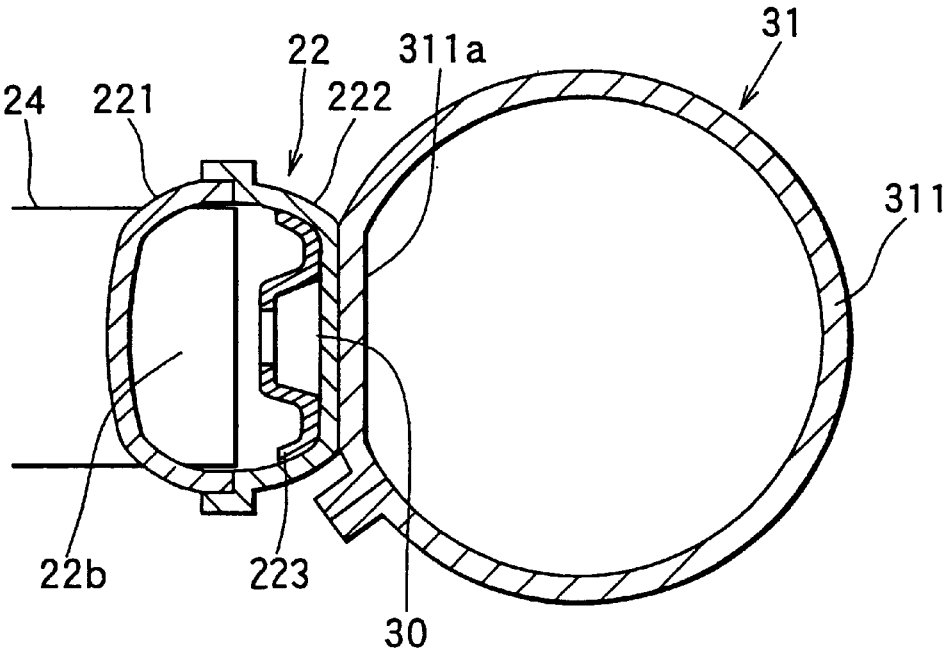
FIG. 7 is a transverse sectional view showing a main portion of a receiver-integrated refrigerant condenser of a refrigerant cycle according to a fourth preferred embodiment of the present invention.

A fourth preferred embodiment of the present invention will be now described with reference to FIG. 7. In the fourth embodiment of the present invention, the components similar to those in the first embodiment are indicated with the same reference numbers, and explanation thereof is omitted. As shown in FIG. 7, in the fourth embodiment, a partition plate 223 extending in the up-down direction (i.e., longitudinal direction of the second header tank) is disposed so that the communication passage 30 is formed in the second header tank 22. In this case, the flat portion 222*a* of the second plate 222 is connected to the flat portion 311*a* of the cylindrical body portion 311 of the receiving unit 31, thereby integrating the receiving unit 31 and the second header tank 22. In the fourth embodiment, at least two parts in the first plate 221, the second plate 222 and the partition plate 223 can be integrally formed by protruding.

Figure 8:
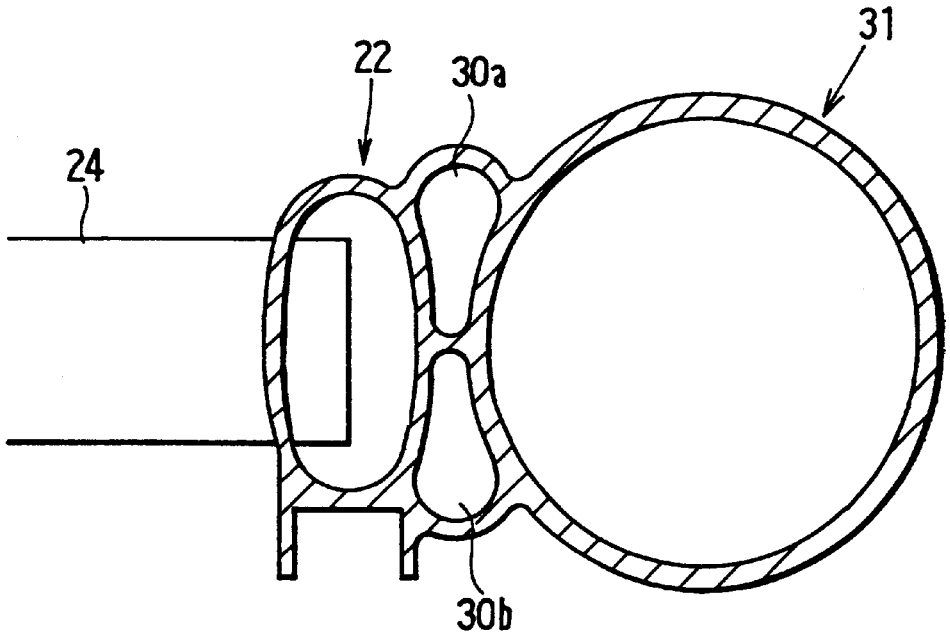
FIG. 8 is a transverse sectional view showing a main portion of a receiver-integrated refrigerant condenser of a refrigerant cycle according to a modification of the first through fourth embodiments of the present invention.

In each of above-described first through fourth embodiments of the present invention, the single communication passage 30 is provided between the second header tank 22 and the receiving unit 31. However, plural communication passages may be provided between the second header tank 22 and the receiving unit 31. For example, in FIG. 8, first and second communication passages 30*a*, 30*b* are provided between the second header tank 22 and the receiving unit 31. In this case, the second header tank 22, the receiving unit 31 and members for defining the first and second communication passages 30*a*, 30*b* may be integrally formed by protruding as shown in FIG. 8. Further, the second header tank 22, the receiving unit 31 and members for defining the first and second communication passages 30*a*, 30*b* may be integrally brazed after being separately formed.

The present invention described above in the first through fourth embodiments may be applied to a receiver-integrated refrigerant condenser, in which the core portion 23 only includes the condensing portion 36, and the super-cooling portion 37 is separated from the core portion 23. In this case, the outlet pipe 27 may be omitted from the first header tank 21, and an outlet pipe through which liquid refrigerant within the receiving unit 31 is discharged may be provided in the receiving unit 31. Further, the present invention described in the first through fourth embodiments may be applied to a receiver-integrated refrigerant condenser in which the super-cooling portion 37 is not provided.

Figure 9:
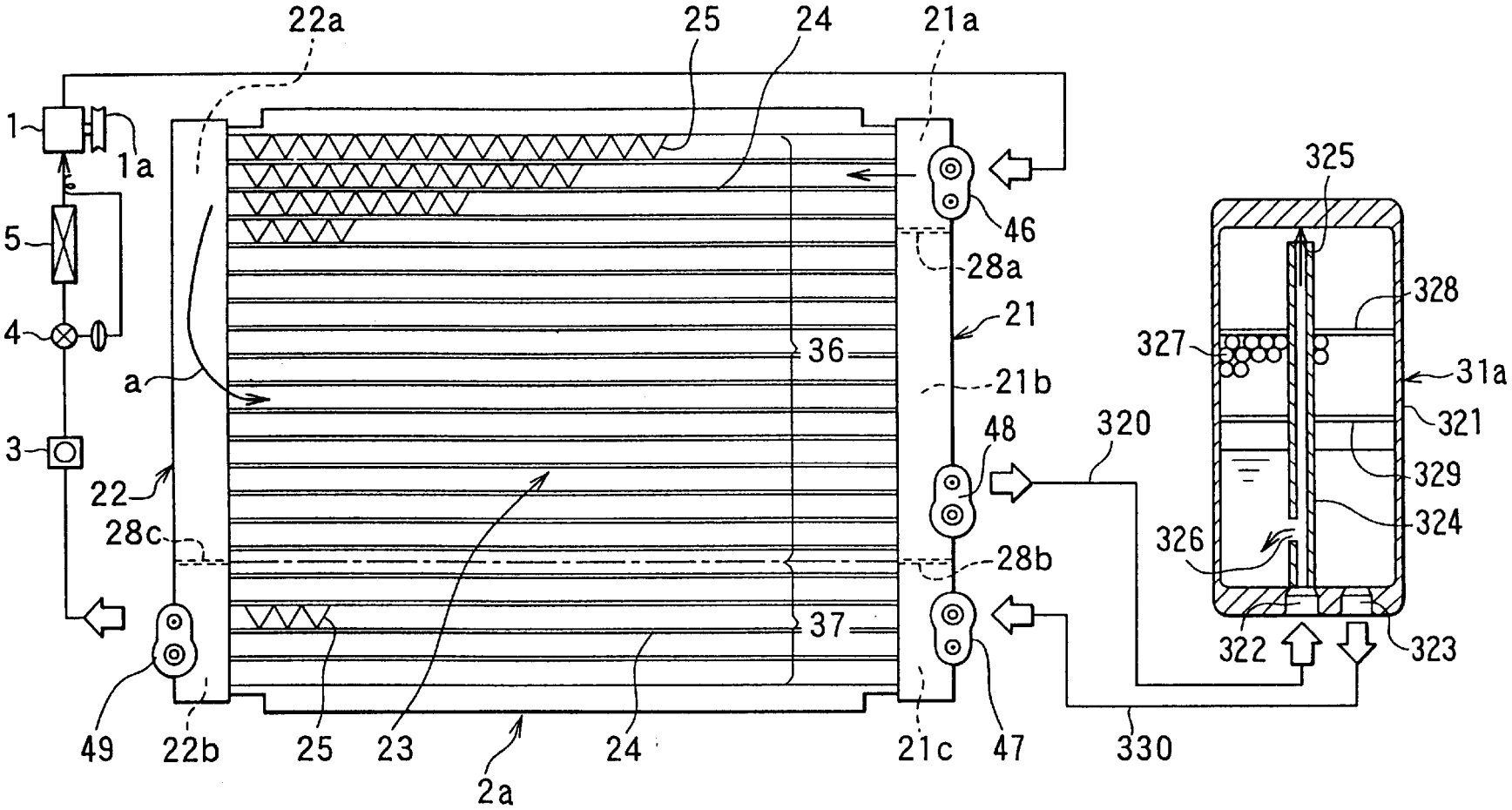
FIG. 9 is a schematic view showing a refrigerant cycle system according to a fifth preferred embodiment of the present invention.

A fifth preferred embodiment of the present invention will be now described with reference to FIG. 9. In the above-described first through fourth embodiments, the receiver-integrated condenser 2 is described. However, in the fifth embodiment, a receiver 31*a* is separated from a condenser 2*a* in a refrigerant cycle, as shown in FIG. 9. Similarly to the above-described first embodiment of the present invention, in the fifth embodiment, the refrigerant cycle includes a refrigerant compressor 1 which is operated when a rotation power of a vehicle engine is applied thereto through a belt and an electromagnetic clutch 1*a*, the condenser 2*a* having therein a super-cooling portion, the receiver 31*a*, a sight glass 3, a thermal expansion valve 4, and a refrigerant evaporator 5. All of components of the refrigerant cycle are serially connected by a metal pipe or a rubber pipe to form a closed circuit.

When the rotation power of the engine is transmitted to the compressor 1 through the electromagnetic clutch 1*a*, the compressor 1 compresses gas refrigerant sucked therein from the evaporator 5 and then discharges high-pressure high-temperature gas refrigerant to the condenser 2*a*.

The condenser 2*a* includes a pair of first and second header tanks 21, 22 each of which extends approximately in an up-down direction (i.e., vertical direction) and is formed into approximately cylindrically. A core portion 23 is disposed between the first and second header tanks 21, 22.

The core portion 23 includes plural flat tubes 24 through which refrigerant flows approximately horizontally between the first and second header tanks 21, 22, and plural corrugated fins 25 each of which is disposed between adjacent flat tubes 24. Each one side end of the flat tubes 24 communicates with the first header tank 21, and each the other side end of the flat tubes 24 communicates with the second header tank 22.

A first inlet pipe 46 through which refrigerant from the compressor 1 is introduced is connected to the first header tank 21 at an upper side, and a second inlet pipe 47 through which refrigerant from the receiver 31*a* is introduced is connected to the first header tank 21 at a lower side. In the first embodiment, first and second separators 28*a*, 28*b* are disposed within the first header tank 21, and a third separator 28*c* is disposed within the second header tank 22. Thus, an inner space of the first header tank 21 is partitioned into upper, intermediate and lower spaces 21*a*, 21*b*, 21*c* in the up-down direction by the first and second separators 28*a*, 28*b*, and an inner space of the second header tank 22 is partitioned into upper and lower spaces 22*a*, 22*b* in the up-down direction by the third separator 28*c*. Thus, refrigerant introduced from the first inlet pipe 26 flows meanderingly between the first and second header tanks 21, 22 and the core portion 23.

In the fifth embodiment, the second separator 28*b* is disposed in the first header tank 21 at the same height position as the third separator 28*c* disposed in the second header tank 22. Therefore, the core portion 23 of the condenser 2*a* is separated into the a condensing portion 36 and a super-cooling portion 37.

The first inlet pipe 46 is connected to the first header tank 21 at a position upper than the first separator 28*a* to communicate with the upper space 21*a*. The second inlet pipe 47 is connected to the first header tank 21 at a position lower than the second separator 28*b* to communicate with the lower space 21*c*. A first outlet pipe 48 through which refrigerant condensed in the condensing portion 36 of the core portion 23 of the condenser 2*a* is introduced into the receiver 31*a* is connected to the first header tank 21 to communicate with a lower side of the intermediate space 21*b*. Further, a second outlet pipe 49 through which refrigerant from the super-cooling portion 37 of the condenser 2*a* flows toward the sight glass 3 is connected to the second header tank 22 to communicate with the lower space 22*b* of the second header tank 22*b*.

In the fifth embodiment, the receiver 31*a* is separated from the condenser 2. Therefore, the first outlet pipe 48 is coupled to the receiver 31*a* through a connection pipe 320, and the second inlet pipe 47 is coupled to the receiver 31*a* through a connection pipe 330. The receiver 31*a* includes a tank body portion 321 (tank member, body portion) in which gas refrigerant is separated from liquid refrigerant while liquid refrigerant is stored therein. The tank body portion 321 is made metal such as aluminum, and is formed into a vertically enlarged cylindrical shape.

An inlet connection part 322 connected to the connection pipe 320, and an outlet connection part 323 connected to the connection pipe 330 are disposed in a bottom portion of the tank body portion 321. An inlet pipe 324 is provided in the tank body portion 321 to extend in an up-down direction, and a lower end of the inlet pipe 324 is fixed to the inlet connection part 322 to communicate with the connection pipe 320. The inlet pipe 324 is disposed vertically in an inner space of the tank body portion 321 so that an upper end of the inlet pipe 324 extends to a position proximate to a top inner surface of the tank body portion 321. The upper end of the inlet pipe 324 is opened to form a first refrigerant inlet 325. Further, a second refrigerant inlet 326 is provided at a lower side part of the inlet pipe 324 to be positioned under a gas-liquid boundary surface during a normal refrigerant sealing state.

A desiccant 327 for dehydrating refrigerant, such as zeolite, is disposed in the tank body portion 321 at a middle position of the inlet pipe 324 in the vertical direction. Both upper and lower sides of the desiccant 327 is held by porous or netlike partition plates 328, 329. In FIG. 9, the tank body portion 321 is indicated as an all integrated structure. However, actually, for inserting the inlet pipe 324, the desiccant 327, the partition plates 328, 329 and the like, the bottom portion of the tank body portion 321 is separated from the other part of the tank body portion 321.

Next, operation of the refrigerant cycle according to the fifth embodiment will be now described. When operation of the air conditioner starts and the electromagnetic clutch 1*a* is turned on, rotation power of the engine is transmitted to the compressor 1 so that refrigerant is pressed and discharged by the compressor 1. Thus, super-heating gas refrigerant discharged from the compressor 1 flows into the upper space 21*a* of the first header tank 21 of the condenser 2*a* through the first inlet pipe 46. Refrigerant in the upper space 21*a* of the first header tank 21 flows into the upper space of the second header tank 22 after passing through the upper side tubes 24 of the condensing portion 36. Refrigerant is U-turned in the upper space 22*a* of the second header tank 22 as shown by arrow "a" in FIG. 9, flows through lower tubes 24 in the condensing portion 36, and thereafter flows into the intermediate space 21*b* of the first header tank 21. While refrigerant flows through the tubes 24 of the condensing portion 36 of the core portion 23, refrigerant is heat-exchanged with air to become in a saturation liquid refrigerant containing a part of gas refrigerant. The saturation liquid refrigerant flows into the inlet connection part 322 from the intermediate space 22*b* of the second header tank 22 through the first outlet pipe 48 and the connection pipe 320. Refrigerant introduced into the inlet pipe 314 from the inlet connection part 322 flows into the inner space of the tank body portion 321 from both the first and second refrigerant inlets 325, 326 of the inlet pipe 324.

Gas refrigerant and liquid refrigerant are separated in the tank body portion 321, and liquid refrigerant is stored in the tank body portion 321. Liquid refrigerant separated in the receiver 31*a* flows from a refrigerant outlet of the outlet connection part 323 into the tubes 24 of the super-cooling portion 37 after passing through the connection pipe 330, the second inlet pipe 47 and the lower space 21*c* of the first header tank 21. Liquid refrigerant is cooled again in the super-cooling portion 37, and super-cooled liquid refrigerant flows into the lower space 22*b* of the second header tank 22, and flows to the outside of the condenser 2*a* from the second outlet pipe 49.

The super-cooled liquid refrigerant passes through the sight glass 3, and flows into the expansion valve 4. The super-cooled refrigerant is decompressed in the expansion valve 4 to becomes in low-temperature low-pressure gas-liquid refrigerant. Gas-liquid refrigerant is heat-exchanged with air in the evaporator 5, so that air passing through the evaporator 5 is cooled by absorbing evaporation latent heat of refrigerant. Super-heating gas refrigerant evaporated in the evaporator 5 is sucked into the compressor 1 to be compressed again.

According to the fifth embodiment, refrigerant condensed in the condensing portion 36 of the core portion 23 flows into the inlet pipe 324 of the receiver 31*a,* and flows from both the first and second refrigerant inlets 325, 326 of the inlet pipe 324 into the upper and lower sides of the tank body portion 311 relative to the gas-liquid boundary surface. The first refrigerant inlet 325 is opened toward the top inner surface (ceiling portion) of the tank body portion 321 at an approximate center of the tank body portion 321 near the top inner surface of the tank body portion 321. Therefore, refrigerant from the first refrigerant inlet 315 flows toward a center of the top inner surface of the tank body portion 321 to collide with the top inner surface of the tank body portion 321. Refrigerant after colliding with the top inner surface of the tank body portion 321 moves outerwardly on the top inner surface of the tank body portion 321, and falls along an inner peripheral cylindrical surface of the tank body portion 321. Accordingly, the upper side part of the receiver 31*a* can be always cooled by refrigerant cooled in the condensing portion 36 of the condenser 2*a*. Thus, even when the receiver 31*a* is used in a condition where heat radiated from a vehicle engine or hot air after passing through a radiator is transmitted to the receiver 31*a,* it can effectively prevent liquid refrigerant at an upper side of the receiver 31*a* from being boiled. Therefore, the liquid refrigerant surface can be increased within the receiver 31*a,* and refrigerant-sealing performance within the receiver 31*a* is improved.

Further, refrigerant from the condensing portion 36 of the condenser 2*a* also flows from the second refrigerant inlet 326 of the inlet pipe 324 into the liquid refrigerant at a lower side within the tank body portion 321. Therefore, the gas-liquid boundary surface is prevented from being disturbed.

According to the fifth embodiment, because refrigerant flowing into the inner space of the tank body portion 321 is separated into two parts, the dynamical pressure of refrigerant injected from the first refrigerant inlet 325 can be sufficiently decreased. In addition, refrigerant from the first refrigerant inlet 325 is injected toward the top inner surface of the tank body portion 321 to college with the top inner surface, and is introduced toward the gas-liquid boundary surface after passing through clearances between particles of the desiccant 327. Therefore, the gas-liquid boundary surface is not disturbed by the dynamical pressure of refrigerant from the first refrigerant inlet 325. Accordingly, it can prevent gas refrigerant from being mixed into refrigerant discharged from the refrigerant outlet of the outlet connection part 323. As a result, a liquid refrigerant surface can be moved upwardly within the receiver 31*a,* and the refrigerant-sealing performance can be further improved.

Figure 10:
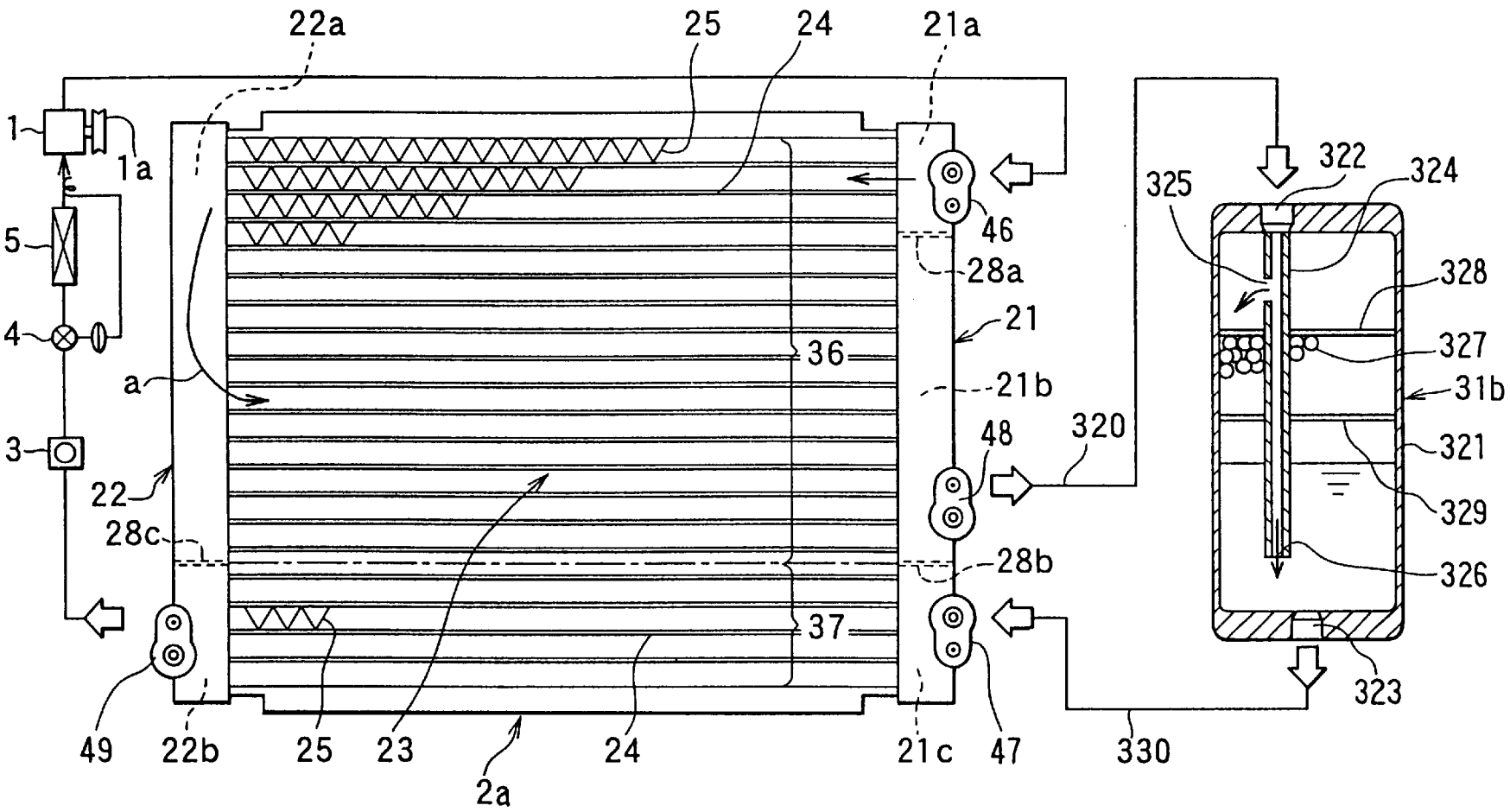
FIG. 10 is a schematic view showing a refrigerant cycle system according to a sixth preferred embodiment of the present invention.

A sixth preferred embodiment of the present invention will be now described with reference to FIG. 10. In the above-described fifth embodiment, both the inlet connection part 322 and the outlet connection part 323 are provided in the bottom portion of the tank body portion 321. However, in a receiver 31*b* of the sixth embodiment, the inlet connection part 322 is disposed in the top portion of the tank body portion 321. That is, the top end of the inlet pipe 324 is fixed to the inlet connection part 322 to communicate with the connection pipe 320. Accordingly, the first refrigerant inlet 325 is provided at an upper side of the inlet pipe 324 upper than the desiccant 327. The bottom end of the inlet pipe 324 penetrates through the desiccant 327, and extends to a position proximate to the bottom surface of the tank body portion 321. The second refrigerant inlet 326 is formed in the bottom end of the inlet pipe 324. Even in this case, because refrigerant condensed and cooled in the condensing portion 36 of the condenser 2*a* flows into both upper and lower sides of the tank body portion 321 from both the first and second refrigerant inlets 325, 326, the effect similar to the above-described fifth embodiment can be obtained. In the sixth embodiment, the other parts are similar to those of the above-described fifth embodiment.

Figure 11:
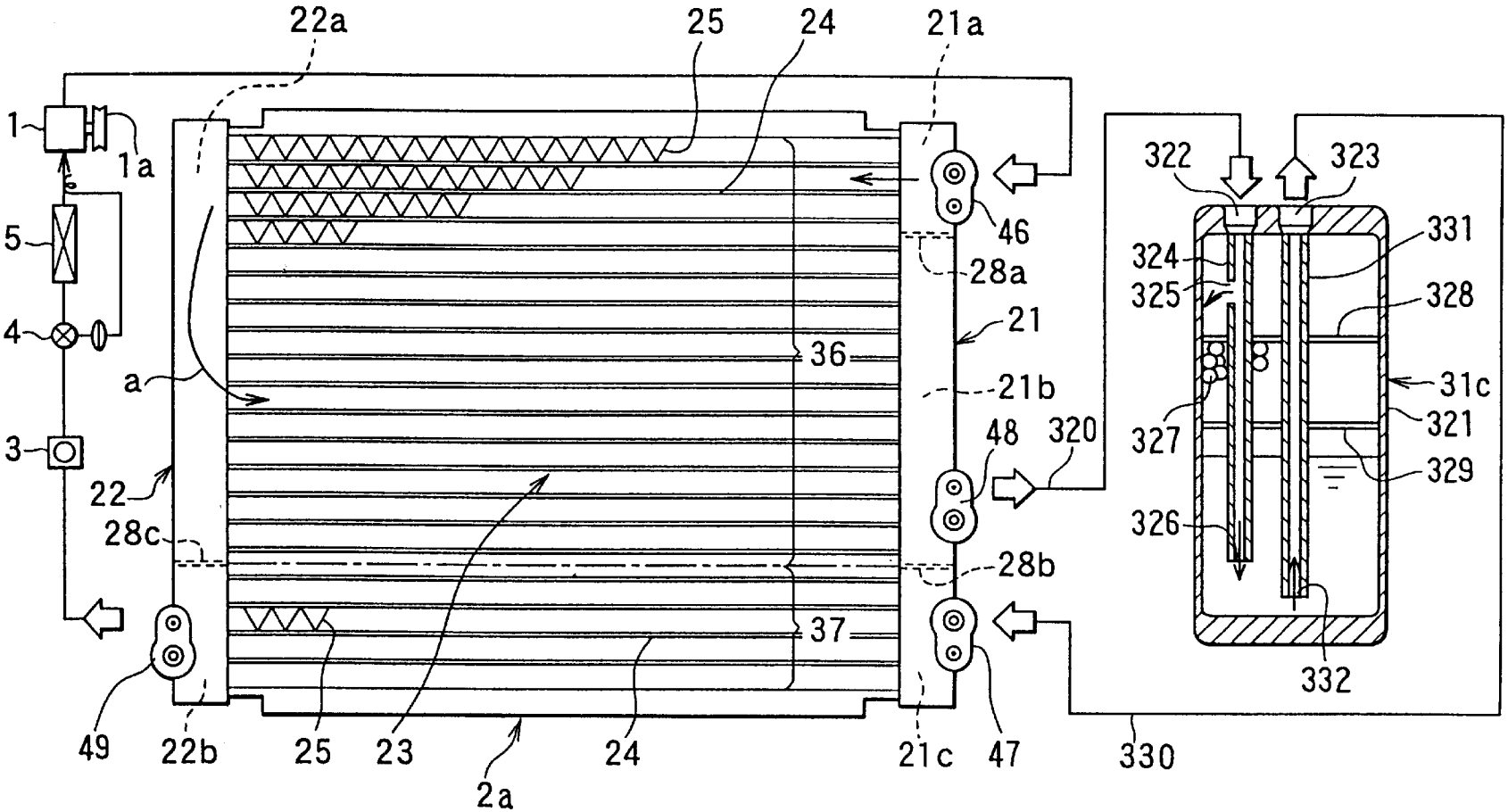
FIG. 11 is a schematic view showing a refrigerant cycle system according to a seventh preferred embodiment of the present invention.

A seventh preferred embodiment of the present invention will be now described with reference to FIG. 11. In a receiver 31*c* of the seventh embodiment, the structure of the refrigerant outlet of the above-described sixth embodiment is changed. That is, the outlet connection part 323 is also provided in the top portion of the tank body portion 321, and an outlet pipe 331 is connected to the outlet connection part 323 to communicate with the connection pipe 330. The outlet pipe 331 penetrate through the desiccant 327, and a bottom end of the outlet pipe 331 is opened downwardly at a position lower than the second inlet 326 of the inlet pipe 324. The opened bottom end defines a suction port 332 through which liquid refrigerant is sucked. In the seventh embodiment, the other parts are similar to those of the above-described fifth and sixth embodiments, and the effect similar to that of the fifth embodiment is obtained.

An eighth preferred embodiment of the present invention will be now described with reference to FIG. 12. In the above-described first through fourth embodiments, the condenser 2 is integrated with the receiving unit 31 while the communication passage 30 is provided therebetween. On the other hand, in the above-described fifth through seventh embodiments of the present invention, the condenser 2*a* is separated from the receiver 31*a,* 31*b,* 31*c.* In the eighth embodiment, first tank 21 of the condenser 2 is simply integrated with the receiving unit 31 without providing a communication passage therebetween.

Figure 12:
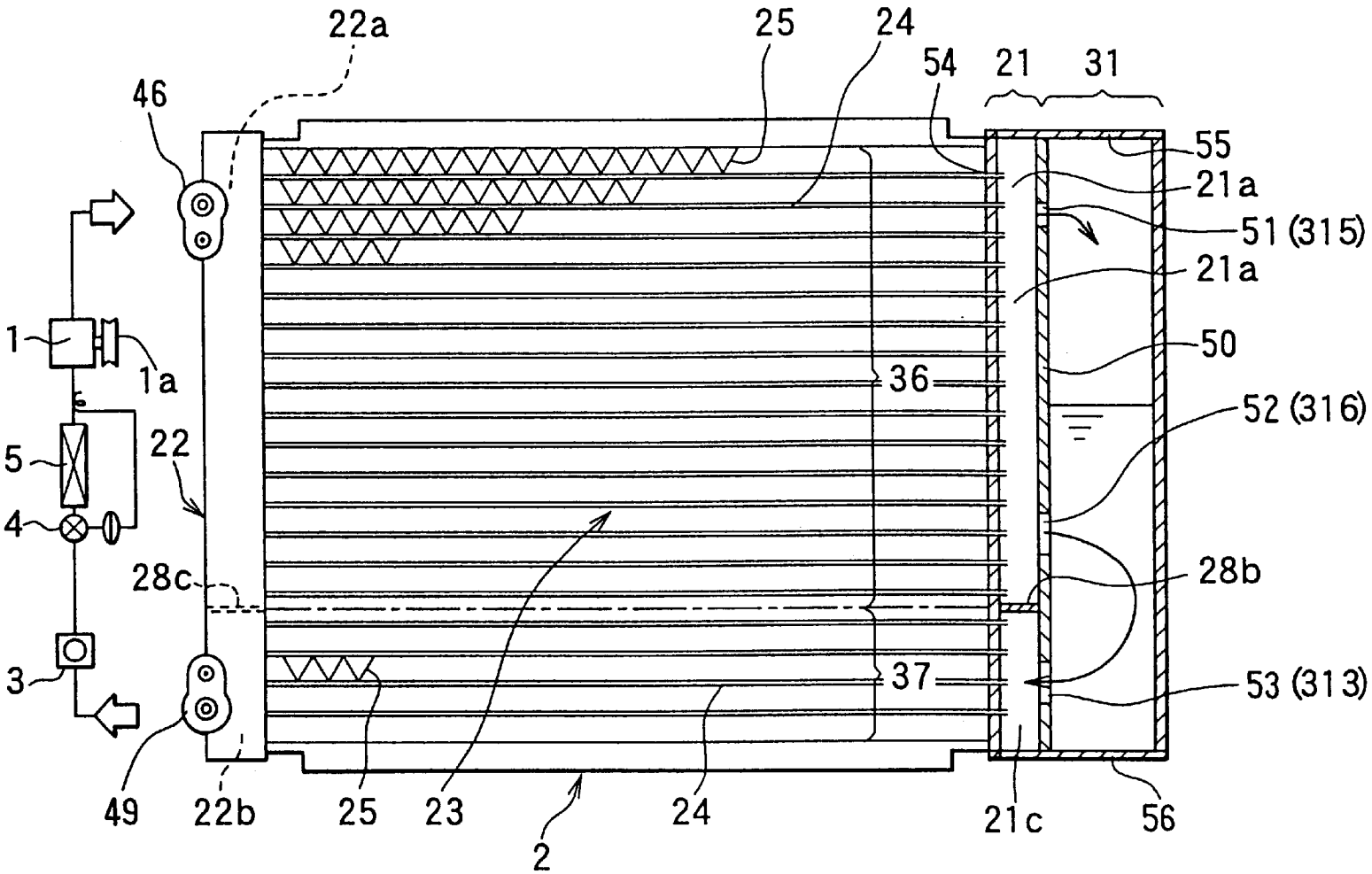
FIG. 12 is a schematic view showing a refrigerant cycle system according to an eighth preferred embodiment of the present invention.
Figure 13:
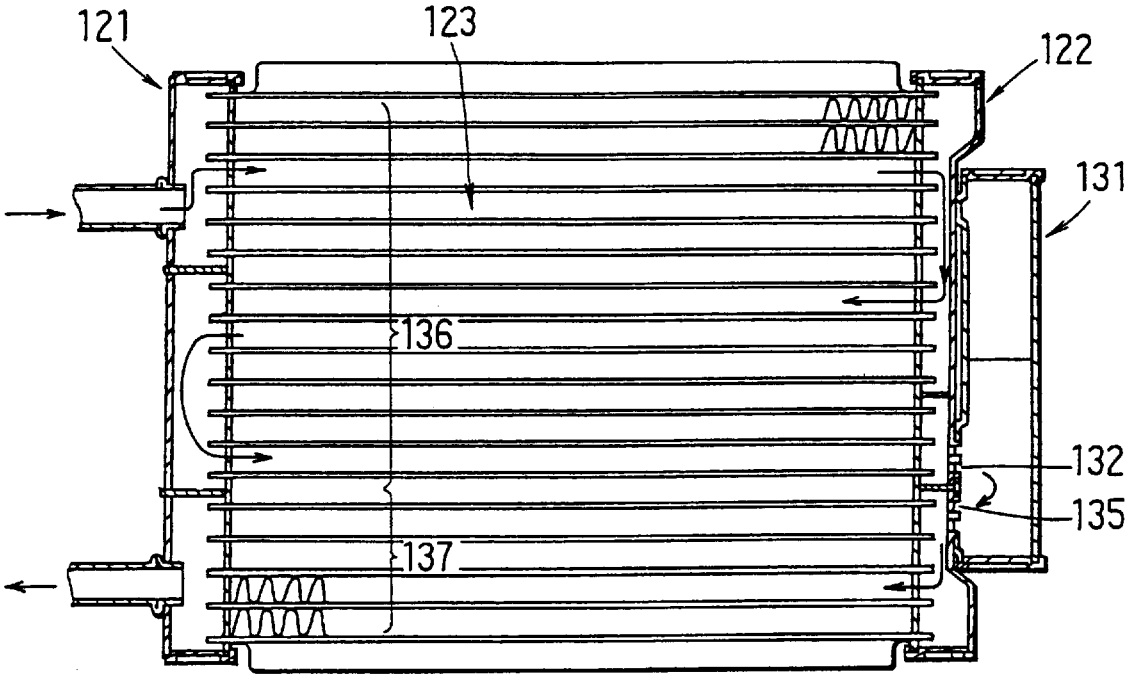
FIG. 13 RELATED ART
FIG. 13 is a schematic sectional view showing a conventional receiver-integrated refrigerant condenser.

As shown in FIG. 12, the first header tank 21 and the receiving unit 31 are integrated along the up-down direction. For example, both tank shapes of the first header tank 21 and the receiving unit 31 are integrally formed by extrusion. An inner space within the first header tank 21 is partitioned by a single separator 28*b* into upper and lower spaces 21*a,* 21*c.* Similarly, the inner space of the second header tank 22 is also partitioned by a single separator 28*c* into upper and lower spaces 22*a,* 22*b.* Both the separators 28*b,* 28*c* are positioned at the same height position. Therefore, refrigerant from the compressor 1 flows into the upper space 22*a* of the second header tank 22 through the inlet pipe 46, and then passes through the condensing portion 36 of the core portion 23. Refrigerant from the condensing portion 36 of the core portion 23 flows into the upper space of the first header tank 21. Three communication holes 51, 52, 53 are provided in a partition wall 50 extending in the up-down direction. The partition wall 50 is disposed to partition the receiving unit 31 and the first header tank 21 from each other. The top communication hole 51 is provided in the partition wall 50 so that the upper space 21*a* of the first header tank 21 communicates with the upper space of the receiving unit 31. Accordingly, the top communication hole 51 corresponds to the first refrigerant inlet 325 of the above-described fifth embodiment.

The middle communication hole 52 is provided in the partition wall 50, so that a lower part of the upper space 21*a* of the first header tank 21 communicates with the lower part of the receiving unit 31 under the gas-liquid boundary surface through the middle communication hole 52. Accordingly, the middle communication hole 52 corresponds to the second refrigerant inlet 326 of the above-described fifth embodiment.

The bottom communication hole 53 is provided in the partition wall 50, so that the lower space 21*c* of the first header tank 21 communicates with a bottom area within the receiving unit 31. Therefore, liquid refrigerant stored in the receiving unit 31 can directly flow into the lower space 21*c* of the first header tank 21. Accordingly, the bottom communication hole 53 corresponds to the refrigerant outlet of the outlet connection part 323 of the above-described fifth embodiment.

According to the eighth embodiment, even when the receiving unit 31 is simply integrated with the header tank of the condenser 2, refrigerant from the condensing portion 36 can be introduced into the receiving unit 31 from upper and lower sides through both the communication holes 51, 52. Thus, the effect similar to that of the above-described fifth embodiment can be obtained.

In the eighth embodiment, the three communication holes 51, 52, 53 and tube-insertion holes 54 are opened after the aluminum extrusion. Further, both upper and lower opened ends of the receiving unit 31 and the first header tank 21 are closed by cap members 55, 56.

In the eighth embodiments, both the first header tank 21 and the receiving unit 31 may be integrally bonded by brazing after being separately formed.

In the above-described fifth through eighth embodiments, the super-cooling portion 37 can be independently separately formed from the core portion 23. Even in this case, the present invention can be applied. Further, the super-cooling portion 37 can be omitted, and the refrigerant outlet of the receiver may be directly coupled to the sight glass 3.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A receiver for a refrigerant cycle system having a condenser, comprising:

a tank member for separating refrigerant from the condenser into gas refrigerant and liquid refrigerant, and for storing liquid refrigerant therein;

a first refrigerant inlet part from which refrigerant from the condenser is directly introduced into an upper side within said tank member;

a second refrigerant inlet part from which refrigerant from the condenser is directly introduced into a lower side lower than said first refrigerant inlet part within said tank member; and a refrigerant outlet part from which liquid refrigerant within said tank member is introduced to an outside of said tank member.

2. The receiver according to claim 1, wherein said refrigerant outlet part is disposed at a position lower than said second refrigerant inlet part.

3. The receiver according to claim 1, further comprising:

an inlet pipe, disposed in said tank member to extend in an up-down direction, through which refrigerant from the condenser flows, wherein:

said first refrigerant inlet part is provided at an upper side of said inlet pipe in said inlet pipe; and said second refrigerant inlet part is provided in said inlet pipe at a position lower than said first refrigerant inlet part.

4. The receiver according to claim 3, wherein said inlet pipe is disposed in said tank member in such a manner that refrigerant from said first refrigerant inlet part flows toward a top inner surface of said tank member.

5. The receiver according to claim 1 further comprising:

a desiccant member disposed in the tank member at a middle position in an up-down direction, wherein:

said first refrigerant inlet part is provided at a, position upper than said desiccant member;

said second refrigerant inlet part is provided at a position lower than said desiccant member; and said desiccant member is disposed in such a manner that refrigerant flowing into said tank member from said first refrigerant inlet part flows downwardly through clearances of said desiccant member within said tank member.

6. The receiver according to claim 1, wherein said tank member is integrally provided with the condenser.

7. The receiver according to claim 1, wherein said tank member is coupled with the condenser through a pipe member.

8. A refrigerant cycle system comprising:

a compressor for compressing refrigerant;

a condenser having a condensing portion for cooling and condensing refrigerant discharged from said compressor, and a super-cooling portion for super-cooling liquid refrigerant; and a receiver for separating refrigerant from said condensing portion of said condenser into gas refrigerant and liquid refrigerant, and for storing liquid refrigerant, wherein:

said receiver has a first refrigerant inlet from which refrigerant having passed through said condensing portion is introduced into an upper side within said receiver, a second refrigerant inlet from which refrigerant having passed through said condensing portion is introduced into a lower side within said receiver, said second. refrigerant inlet being provided at a position lower than said first refrigerant inlet, and a refrigerant outlet from which liquid refrigerant stored within said receiver flows toward said super-cooling portion of said condenser.

9. The refrigerant cycle system according to claim 8, wherein said receiver is separated from said condenser, and is coupled with said condenser through a pipe member.

10. The refrigerant cycle system according to claim 9, wherein:

said receiver has therein an inlet pipe extending in an up-down direction, through which refrigerant from the condensing portion flows into said receiver;

said first refrigerant inlet is provided in said inlet pipe at an upper side of said inlet pipe; and said second refrigerant inlet is provided in said inlet pipe at a position lower than said first refrigerant inlet.

11. The refrigerant cycle system according to claim 8, wherein said receiver and said condenser are an integrated member.

12. The refrigerant cycle system according to claim 11, wherein:

said condenser includes a first header tank integrated with said receiver, a second header tank having an inlet port from which refrigerant from said compressor is introduced, and a core portion having said condensing portion and said super-cooling portion between said first header tank and said second header tank; and said first header tank is connected to a wall part of said receiver at a side opposite to said core portion.

13. The refrigerant cycle system according to claim 12, wherein:

said wall part of said receiver extends in the up-down direction; and said first and second refrigerant inlets are provided in said wall part of said receiver to be opened in said receiver.

14. The refrigerant cycle system according to claim 13, wherein said first header tank and said wall part of said receiver are disposed in such a manner that an inner space of said first header tank directly communicates with upper and lower sides of an inner space of said receiver through said first and second refrigerant inlets.

15. The refrigerant cycle system according to claim 13, wherein:

said first header tank and said wall part of said receiver are disposed to form a communication passage extending in the up-down direction, between said first header tank and said wall part of said receiver; and said communication passage is provided in such a manner refrigerant from said first header tank flows into both said first and second refrigerant inlets through said communication passage.

16. A receiver-integrated condenser comprising:

a core portion having a plurality of tubes through which refrigerant flows in a horizontal direction;

a first header tank extending in a vertical direction perpendicular to the vertical direction, said first header tank being connected to each one side end of said tubes to communicate with said tubes;

a second header tank extending in the vertical direction, said second header tank being connected to each the other side end of said tubes to communicate with said tubes;

a receiving unit for separating gas refrigerant and liquid refrigerant, and for receiving liquid refrigerant; and a separator disposed within said second header tank in such a manner that an inner space of said second header tank is partitioned into upper and lower spaces in the vertical direction, wherein:

said receiving unit is integrated with said second header tank in such a manner that a communication passage extending over both sides of said separator in the vertical direction is defined by said receiving unit and said second header tank;

said second header tank communicates with said communication passage in such a manner that refrigerant condensed in said core portion flows into said communication passage through said lower space of said second header tank; and said communication passage communicates with said receiving unit in such a manner that refrigerant in said communication passage flows into said receiving unit from upper and lower sides.

17. The receiver-integrated condenser according to claim 16, further comprising:

means for forming a first communication hole through which refrigerant in said communication passage flows into said receiving unit from a lower side lower than said separator in the vertical direction; and means for forming a second communication hole through which refrigerant in said communication passage flows into said receiving unit from an upper side upper than said separator in the vertical direction.

18. The receiver-integrated condenser according to claim 17, wherein:

said first communication hole has a first opening area;

said second communication hole has a second opening area larger than the first opening area; and a ratio of said second opening area to said first opening area is in a range of 2–4.

19. The receiver-integrated condenser according to claim 16, wherein:

said second header tank has a tank portion forming a refrigerant passage and a recess portion recessed from said tank portion toward an inner side of said second header tank; and said recess portion of said second header tank extends in the vertical direction, and is connected to said receiving unit to form said communication passage between said recess portion of said second header tank and said receiving unit.

20. The receiver-integrated condenser according to claim 16, wherein:

said receiving unit has a body portion forming a refrigerant passage extending in the vertical direction, and a recess portion recessed from said body portion toward an inner side of said receiving unit; and said recess portion of said receiving unit extends in the vertical direction, and is connected to said second header tank to form said communication passage between said recess portion of said receiving unit and said second header tank.

21. The receiver-integrated condenser according to claim 16, further comprising:

a partition member extending in the vertical direction within said receiving unit, wherein said partition member is disposed to form said communication passage within said receiving unit.

22. The receiver-integrated condenser according to claim 16, wherein:

said receiving unit has a body portion for forming a refrigerant passage extending in the vertical direction;

said body portion has a hollow portion for forming said communication passage; and said body portion of said receiving unit is integrally formed by extruding.

23. The receiver-integrated condenser according to claim 16, further comprising:

a partition member extending in the vertical direction within said second header tank, wherein said partition member is disposed to form said communication passage within said second header tank.

24. The receiver-integrated condenser according to claim 23, wherein:

said second header tank has first and second plates extending in the vertical direction;

said tubes are connected to said first plate of said second header tank;

said receiving unit is connected to said second plate of said second header tank; and at least two parts within said first and second plates and said partition member are formed integrally by extruding.

25. The receiver-integrated condenser according to claim 16, further comprising an inlet pipe connected to said first header tank, through which refrigerant is introduced into said first header tank.

26. The receiver-integrated condenser according to claim 25, further comprising an outlet pipe, connected to said first header tank at a lower side of said inlet pipe, through which refrigerant from said receiving unit is discharged.

27. The receiver-integrated condenser according to claim 26, wherein said core portion includes a condensing portion disposed at an upper side, for condensing refrigerant introduced from said inlet pipe, and a super-cooling portion disposed at a lower side, for super-cooling refrigerant flowing from said receiving unit.

28. The receiver-integrated condenser according to claim 16, wherein said communication passage includes plural passage portions extending in the vertical direction.

29. The receiver-integrated condenser according to claim 16, wherein said receiving unit and said second header tank are integrally formed by protruding to form said communication passage.

30. The receiver-integrated condenser according to claim 16, wherein said receiving unit and said second header tank are integrally brazed after being separately formed.

31. A receiver-integrated condenser comprising:

a core portion having a plurality of tubes through which refrigerant flows in a horizontal direction;

a first header tank extending in a vertical direction perpendicular to the horizontal direction, said first header tank being connected to each one side end of said tubes to communicate with said tubes;

a second header tank extending in the vertical direction, said second header tank being connected to each the other side end of said tubes to communicate with said tubes;

a receiving unit for separating gas refrigerant and liquid refrigerant, and for receiving liquid refrigerant; and first and second separators disposed within said second header tank in such a manner that an inner space of said second header tank is partitioned into upper, intermediate and lower spaces in the vertical direction, wherein:

said receiving unit is integrated with said second header tank in such a manner that a communication passage extending over both upper and intermediate spaces in the vertical direction is defined by said receiving unit and said second header tank;

said second header tank communicates with said communication passage in such a manner that refrigerant condensed in said core portion flows into said communication passage through said intermediate space of said second header tank between said first and second separators;

said core portion includes a condensing portion at an upper side for condensing refrigerant, and a super-cooling portion at a lower side for super-cooling refrigerant flowing from said receiving unit; and said communication passage communicates with said receiving unit in such a manner that refrigerant in said communication passage flows into said receiving unit from upper and lower sides, and refrigerant in said receiving unit flows into said super-cooling portion through said lower space of said second header tank.

32. The receiver-integrated condenser according to claim 31, further comprising:

an inlet pipe connected to said first header tank, through which refrigerant is introduced into said condensing portion of said core portion through said first header tank; and an outlet pipe, connected to said first header tank at a lower side of said inlet pipe, through which refrigerant from said receiving unit is discharged through said super-cooling portion of said core portion and said first header tank.

* * * * *